US010900357B2

(12) United States Patent
Wala et al.

(10) Patent No.: US 10,900,357 B2
(45) Date of Patent: Jan. 26, 2021

(54) BLOWING CURTAIN FACE VENTILATION SYSTEM FOR EXTENDED CUT MINING USING PASSIVE REGULATOR

(71) Applicant: University of Kentucky Research Foundation, Lexington, KY (US)

(72) Inventors: Andrzej M. Wala, Lexington, KY (US); Todor P. Petrov, Lexington, KY (US)

(73) Assignee: UNIVERSITY OF KENTUCKY RESEARCH FOUNDATION, Lexington, KY (US)

( * ) Notice: Subject to any disclaimer, the term of this patent is extended or adjusted under 35 U.S.C. 154(b) by 2001 days.

(21) Appl. No.: 14/267,430

(22) Filed: May 1, 2014

(65) Prior Publication Data

US 2014/0329453 A1 Nov. 6, 2014

Related U.S. Application Data

(60) Provisional application No. 61/818,112, filed on May 1, 2013.

(51) Int. Cl.

| | |
|---|---|
| ***E21F 1/00*** | (2006.01) |
| ***E21F 3/00*** | (2006.01) |
| ***E21F 1/14*** | (2006.01) |

(52) U.S. Cl.

CPC ..... *E21F 1/006* (2013.01); *E21F 1/14* (2013.01)

(58) Field of Classification Search

CPC ..... E21F 1/006; E21F 1/14
USPC ..... 454/169–172
See application file for complete search history.

(56) References Cited

U.S. PATENT DOCUMENTS

| | | | | |
|---|---|---|---|---|
| 2,502,207 | A * | 3/1950 | Curley | F04D 29/526 417/423.1 |
| 2,947,239 | A * | 8/1960 | Burgess | E21F 1/14 454/170 |
| 3,464,756 | A | 9/1969 | Burgess, Jr. | |
| 3,602,262 | A * | 8/1971 | Hinden | F01D 9/042 138/37 |
| 3,603,644 | A | 9/1971 | McCleery | |
| 3,715,969 | A | 2/1973 | Burgess, Jr. | |
| 3,747,503 | A | 7/1973 | Lovell | |
| 4,157,204 | A | 6/1979 | Kissell et al. | |
| 4,200,036 | A | 4/1980 | Matta et al. | |
| 4,235,163 | A | 11/1980 | Divers | |
| 4,282,802 | A | 8/1981 | Divers et al. | |
| 4,358,160 | A | 11/1982 | Kissell et al. | |
| 4,380,353 | A | 4/1983 | Campbell et al. | |
| 4,488,575 | A | 12/1984 | Haaz et al. | |
| 4,607,568 | A | 8/1986 | Hill et al. | |
| 4,632,462 | A | 12/1986 | Poling | |
| 4,993,886 | A | 2/1991 | Hofsetter | |
| 5,188,427 | A | 2/1993 | LeBegue et al. | |
| 5,265,941 | A | 11/1993 | Marteney | |

(Continued)

OTHER PUBLICATIONS

International Search Report and Written Opinion for International application No. PCT/US2014/036376 dated Sep. 4, 2014.

*Primary Examiner* — Helena Kosanovic
(74) *Attorney, Agent, or Firm* — King & Schickli, PLLC

(57) ABSTRACT

A ventilation system for an underground mine includes a blowing curtain, a passive regulator in a shape of an airfoil and an airflow ventilation source. The passive regulator is positioned in the air path adjacent a discharge end of the blowing curtain.

8 Claims, 10 Drawing Sheets

(56) References Cited

U.S. PATENT DOCUMENTS

| | | | |
|---|---|---|---|
| 5,407,253 | A | 4/1995 | Page et al. |
| 6,437,457 | B2 | 8/2002 | Roskey |
| 2004/0116064 | A1 | 6/2004 | Travis |

* cited by examiner

BLOWING CURTAIN FACE VENTILATION SYSTEM FOR EXTENDED CUT MINING USING PASSIVE REGULATOR

This utility patent application claims the benefit of priority in U.S. Provisional Patent Application Ser. No. 61/818,112 filed on May 1, 2013, the entirety of the disclosure of which is incorporated herein by reference.

TECHNICAL FIELD

This document relates generally to underground mining and, more particularly, to an improved method of face ventilation during extended cut mining utilizing continuous mining technology.

BACKGROUND

The use of extended-cut (deep-cut) mining with remotely controlled continuous miners is common in the U.S. coal industry. Operators adopt this method to maximize the productivity of their production sections. These advances have created some environmental problems, notably more dust and methane being generated at the face during coal extraction.

One problem associated with this method involves delivering the required amount of air to the immediate face zone: that is the space around the cutting head of the continuous miner at the coal face where coal is being mined out. This air is needed to (a) dilute methane and (b) remove dust at the working face.

There are two ways to ventilate the face area. For thicker high coal seams, auxiliary tubing ventilation is used. For medium and low coal seams a blowing curtain or exhaust curtain may be utilized. Most mines in the eastern United States have medium and low coal seams. The system and method disclosed in this document is particularly adapted for providing enhanced ventilation with blowing curtain.

It is generally assumed that the blowing curtain method, as opposed to the exhaust curtain, achieves greater efficiency in delivering air to the immediate face zone. However, the blowing curtain method is not as effective as generally assumed. In real mining conditions, due to the technological geometry of the entry, both the blowing curtain and the exhaust curtain suffer from one significant disadvantage: intake air separates early from the rib wall and does not fully penetrate the immediate face zone. This phenomenon is called flow separation and does not provide sufficient air for methane dilution and dust removal of the immediate face zone.

This document relates to a new and improved ventilation system incorporating a unique and novel passive regulator in the shape of an airfoil which eliminates flow separation to provide more effective ventilation of the immediate face zone.

SUMMARY

In accordance with the purposes and benefits described herein, a ventilation system is provided for directing a fresh airstream around a face of a working area. The ventilation system comprises a blowing curtain, a passive regulator in a shape of an airfoil. The airflow ventilation source (fan) is outside the working area. The blowing curtain is one in which air is transported through the tight-rib area toward the face. The tight-rib area is channel created by the curtain, the nearest rib, floor and roof of the entry. In one possible embodiment the passive regulator is positioned in the air path at least partially between the blowing curtain and the rib wall. In another possible embodiment the airstream regulator is position in the air path with a leading edge of the airfoil oriented upstream and a trailing edge of the airfoil pointed toward the mine face. In yet another possible embodiment the airstream regulator is positioned in the air path adjacent a discharge end of the blowing curtain.

In one possible embodiment, called WR-I, the airfoil has a chord of 200 cm, a maximum thickness 40 cm at 29.8% of the chord, a maximum camber 9% at 30% of the chord. In another possible embodiment, called WR-II, the airfoil has a chord of 200 cm, a maximum thickness of 60 cm at 29.10% of the chord, a maximum camber of 9% at 31.50% of the chord. The span of the passive regulator vary with the height of the entry.

In addition, the airfoil of WR-II defines and includes a shelter space. A mining machine operator may stand in the shelter space while remotely operating the continuous miner. Advantageously, the shelter space protects the miner from the airstream including the dust as it is swept by the airstream through the return flow path.

In accordance with an additional aspect, a method of ventilating an immediate face zone adjacent a mine face in an underground mine is provided. That method may be broadly described as comprising directing a fresh airstream into the immediate face zone by means of a passive regulator in a shape of an airfoil. The method may further include the step of providing the passive regulator in an air path between a blowing curtain and a rib wall of the underground mine. Further, the method may include providing a shelter space in a cavity on the back side of the airfoil of the airstream regulator. Still further the method may include positioning a mining machine operator in that shelter space.

In accordance with yet another aspect, a passive regulator is provided for directing an airstream toward an immediate face zone adjacent a mine face of an underground mine. The passive regulator comprises an airfoil body having a leading edge oriented upstream and a trailing edge pointed toward the mine face. A shelter space is defined by the airfoil body that is protected from the airstream and dust. Still further the passive regulator may include a base. The airfoil body extends along a longitudinal axis perpendicular to the base which rests upon the mine floor to provide a stable platform to support the airfoil. That longitudinal axis has a length of between 1.0 meters and 2.5 meters in one possible embodiment.

In the following description, there is shown and described a preferred embodiment of the air regulator and the ventilation system. As it should be realized, the regulator and system are capable of other, different embodiments and their several details are capable of modification in various, obvious aspects. Accordingly, the drawings and descriptions should be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles thereof. In the drawings.

Reference will now be made in detail to the present preferred embodiment of the system and passive regulator, an example of which is illustrated in the accompanying drawings.

DETAILED DESCRIPTION

Figure 1:
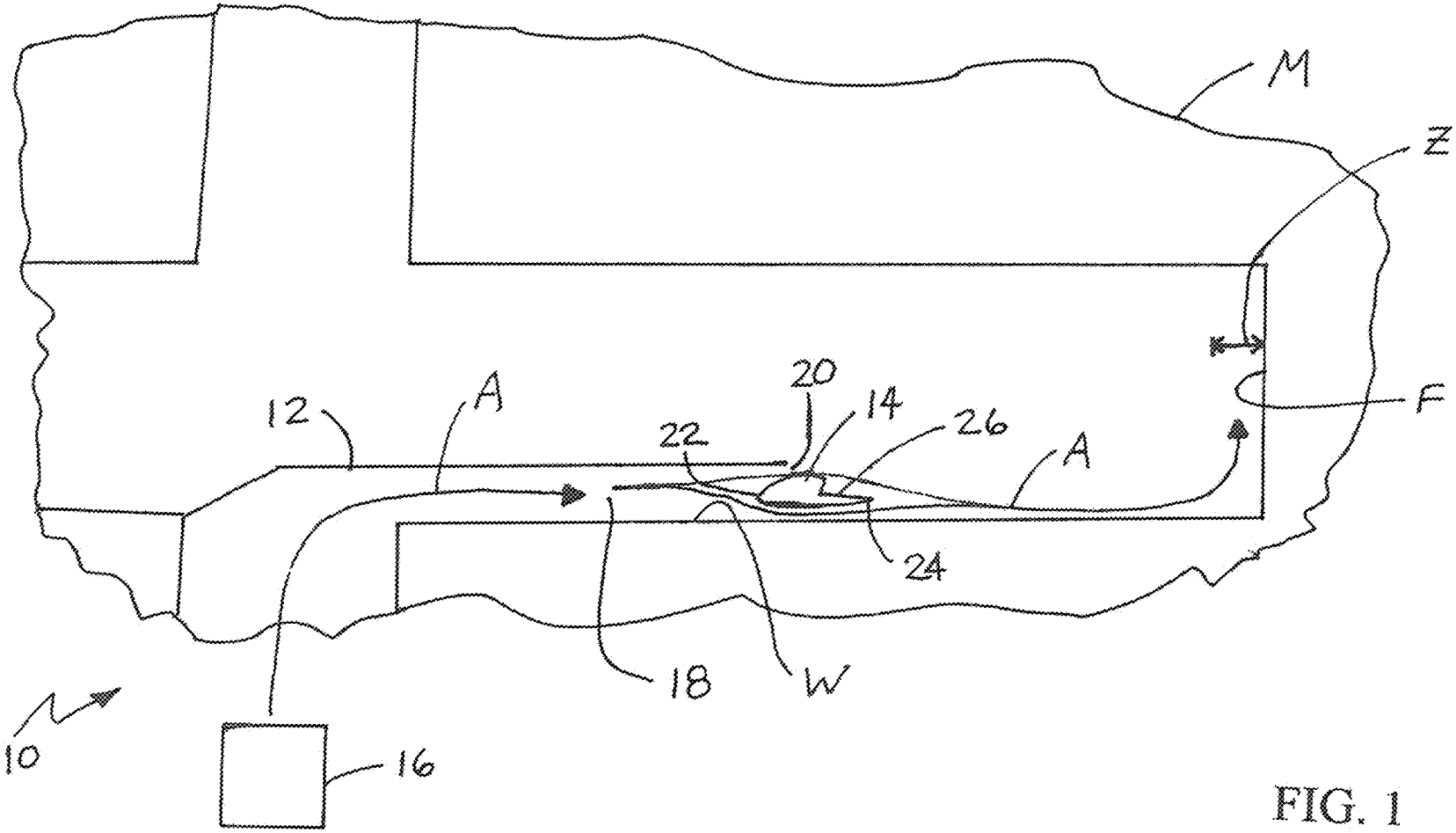
FIG. 1 is a schematical top plan illustration of the current face ventilation system.

Reference is now made to FIG. 1 schematically illustrating a face ventilation system 10 for directing a fresh airstream along an immediate face zone Z adjacent a mine face F (a space immediately in front of the mine face) of a working area of an underground mine M. The system 10 includes a blowing curtain 12, as airstream regulator 14 in the shape of an airfoil and an airstream ventilation source such as a fan 16. In the illustrated embodiment the fan 16 is upstream and is blowing air toward the face F. However, it should be appreciated that the fan 16 could be an exhaust fan positioned downstream drawing air along the blowing curtain 12 and then through the face zone Z.

As illustrated, the blowing curtain 12 is provided along and spaced from a rib wall W so as to define a ventilation air path 18 (typically about four feet in width). The airstream is forced by the fan 16 to travel through the air path 18 in the direction of action arrows A.

As should be appreciated, the airstream regulator 14 is positioned at least partially between the blowing curtain 12 and the rib wall W adjacent a discharge end 20 of the blowing curtain with the leading edge 22 of the airfoil oriented upstream and the trailing edge 24 of the airfoil pointed toward the mine face F. The airfoil shape of the airstream regulator 14 functions to smooth the flow of the airstream, substantially reduce or prevent air flow separation from the rib wall W and increase the flow of fresh air into the immediate face zone Z. As much as 80% more air reaches the immediate face zone Z to dilute methane and remove dust.

Figure 1A:
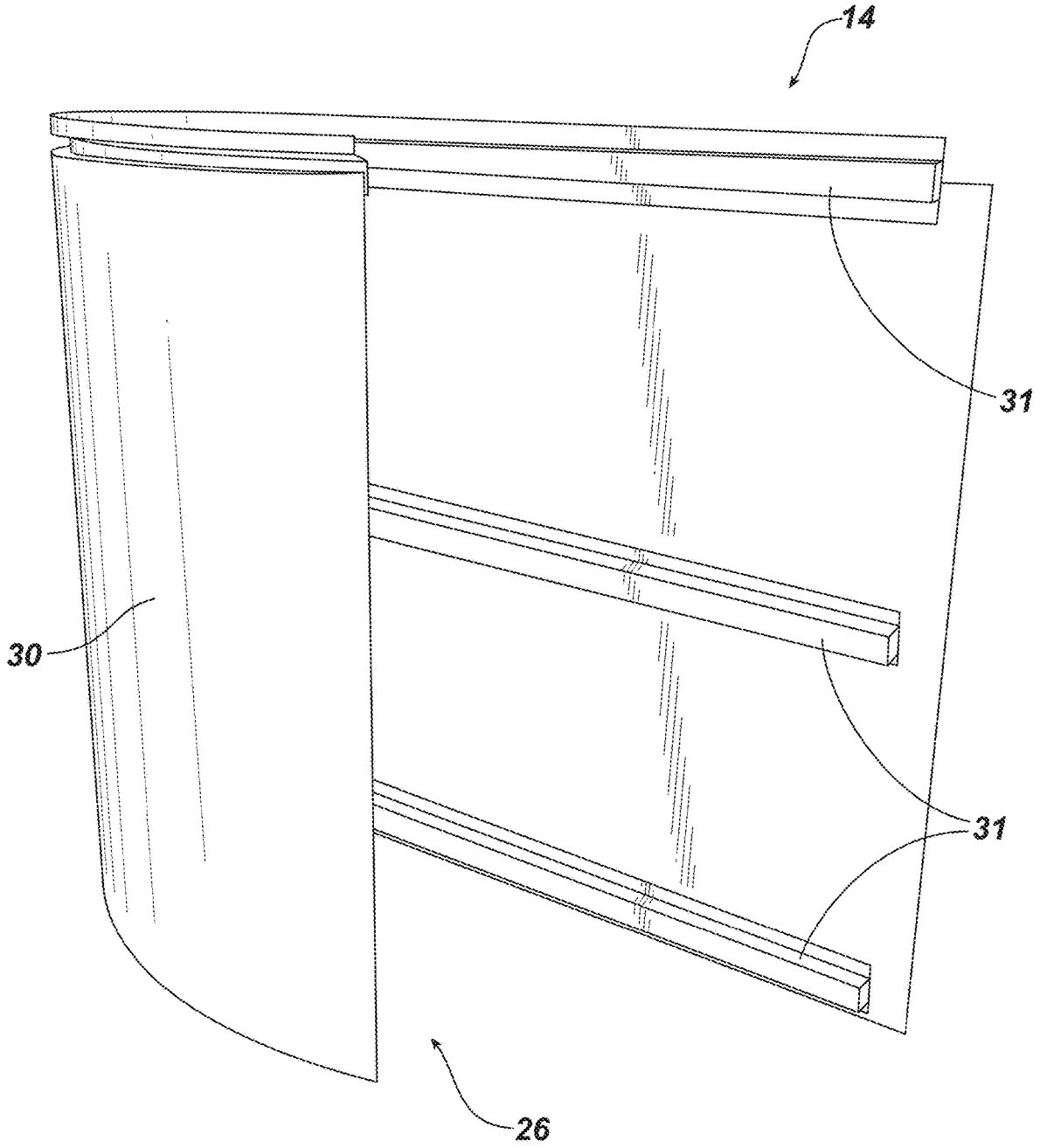
FIG. 1*a* is a perspective view of the airstream regulator clearly showing the shelter space.

As further illustrated in FIG. 1*a*, a shelter space 26, in the form of an open cavity, is provided on the backside of the "hollow", airfoil-shaped airstream regulator 14. An operator may stand in this space 26 in order to remotely operate mining equipment such as a continuous miner. There the operator is protected from the incoming and outgoing airstream and the dirt and dust entrained in that airstream.

The airstream regulator 14 may be made from any suitable material such as relatively light weight aluminum or aluminum alloy. The airfoil body 30 may be of any desired length but generally has a length, from top-to-bottom, of from about 1.0 to about 2.5 meters.

The airfoil body 30 defines a chord C with a maximum thickness T at 29.10% of the chord, a maximum camber MC at 31.50% of the chord, a lateral edge L, an arc edge A and an inclined edge E. In one possible embodiment the airfoil body 30, has a chord of 200 cm, a maximum thickness 40 cm at 29.8% of the chord, a maximum camber 9% at 30% of the chord. One particularly useful embodiment, includes an airfoil body 30 with a chord of 200 cm, a maximum thickness of 60 cm at 29.10% of the chord, a maximum camber of 9% at 31.50% of the chord.

Reference is now made to the following example which further illustrates the invention.

Example 1

Two WR airfoils were successfully tested.

Description of WR-I

Figure 2:
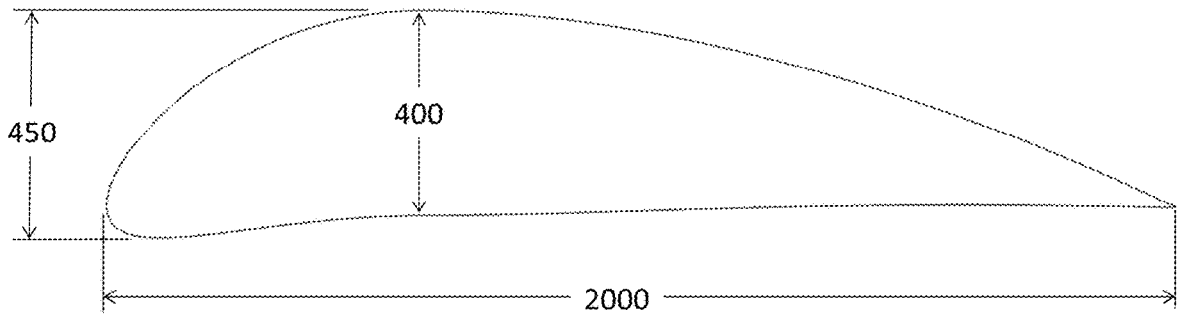
FIG. 2 illustrates the airfoil profile of WR-I.
Figure 3:
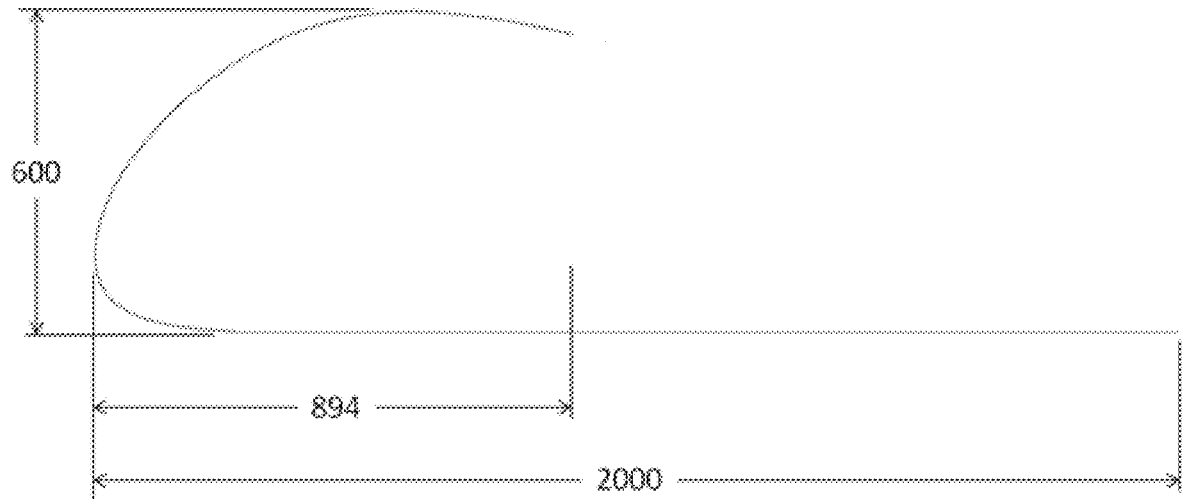
FIG. 3 illustrates the airfoil profile of WR-II.

The profile of the WR-I (FIG. 2) is an airfoil with chord of 2000 mm (78.74 inches), max thickness 400 mm (15.74 inches) at 29.8% of the chord, and max camber 9% at 30% of the chord, The span of the wing-regulator vary with the height of the entry.

Description of WR-II

The profile of the WR-II is a hollow airfoil with chord of 2000 mm (78.74 inches), max thickness 600 mm (23.62 inches) at 29.10% of the chord, max camber 9% at 31.50% of the chord, upper edge. The span of the wing-regulator varies with the height of the entry. This airfoil provides a safe (shelter) space for the continuous miner operator.

WR-I. Field Test Data and CFD Simulation Results

Figure 4:
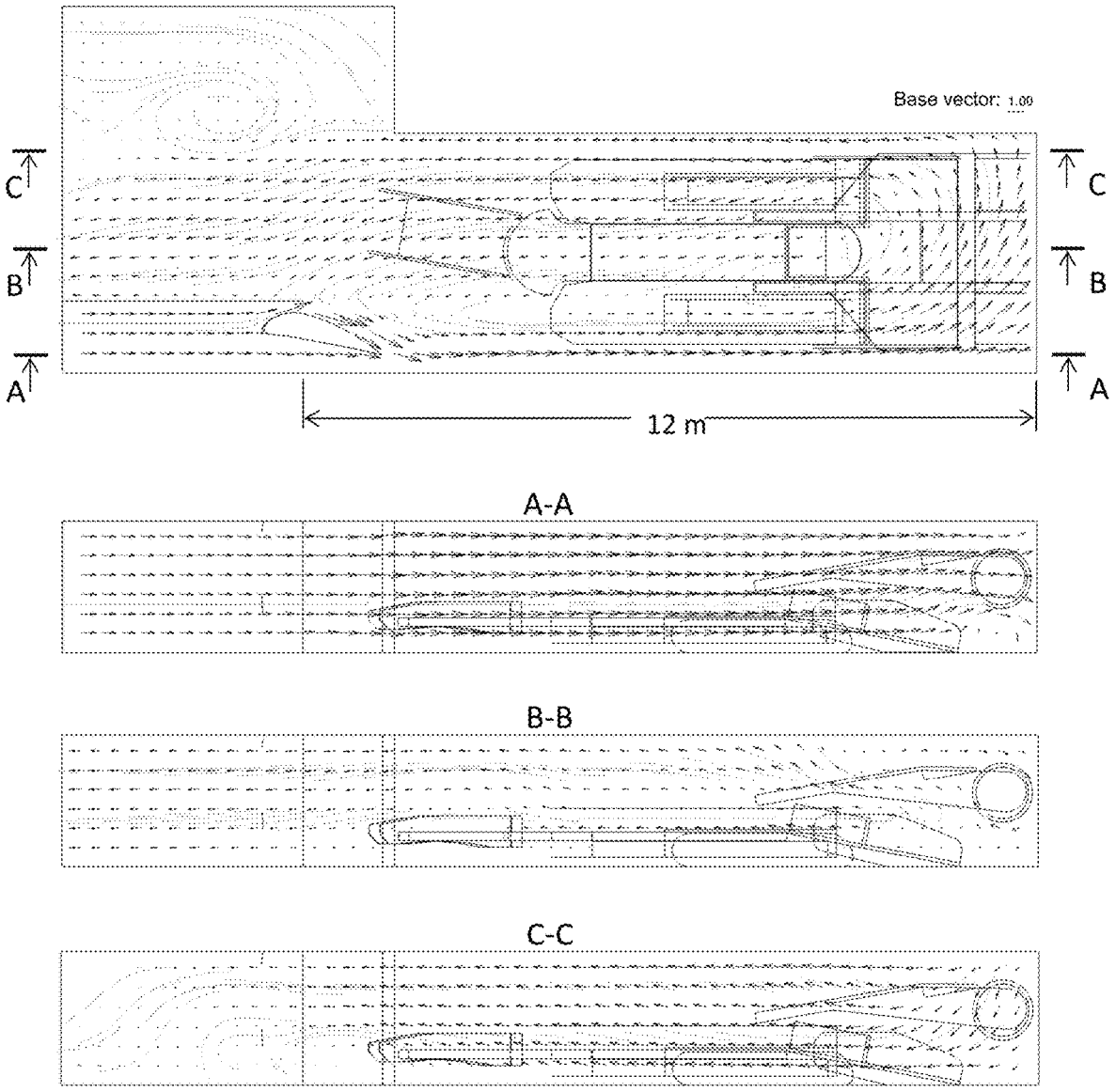
FIG. 4 illustrates computational fluid dynamics (CFD) simulation results of flow patterns developed by WR-I with a continuous miner at the end of the box cut, horizontal section above the miner ($h_{plane}$=0.8 m), (A-A) vertical section of the intake stream, (B-B) vertical section of the flow at the middle of the entry, (C-C) vertical section of the return stream.
Figure 5:
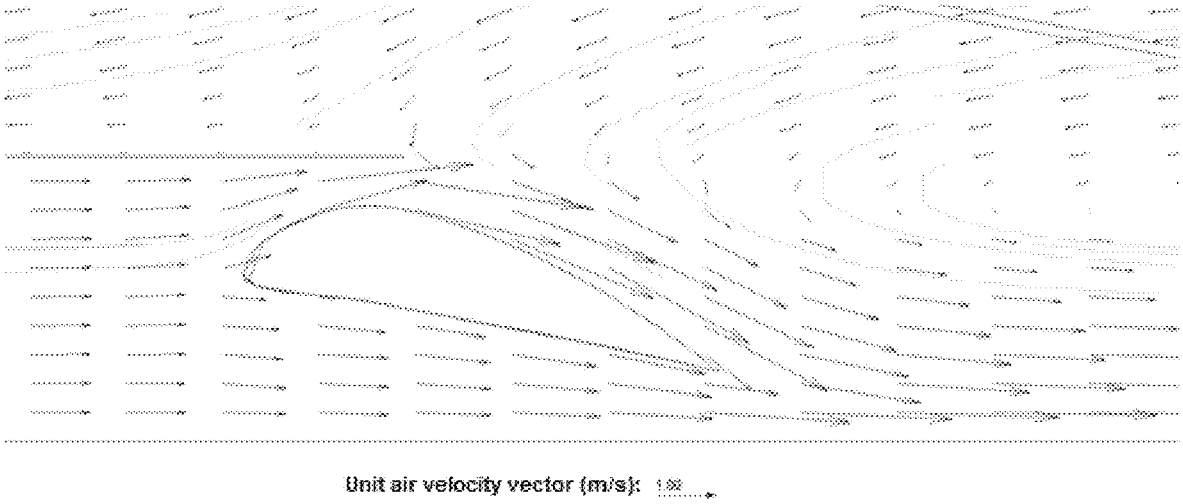
FIG. 5 is a CFD simulation result for WR-I showing airflow velocity vector field around the airfoil.

A prototype of WR-I was successfully tested in a typical setup of a blowing curtain face ventilation system. The test was performed in an equipment free entry with height 1.52 m (5 ft) and width 6.1 m (20 ft). The WR-I was set up at the end of a curtain established at 1.2 m (4 ft) distance from the rib and 12.2 m (40 ft) setback distance to the face. Airflow velocities were measured using hot wire anemometer and visualized by smoke tubes. The results showed no evidence of flow separation. The WR-I developed a stable primary jet stream along the curtain side rib. The flow velocities measured at the immediate face zone were in range of 60%-80% of the average airflow velocity measured behind the curtain. For better illustration of WR-I performance, CFD simulation results with a continuous miner at the end of a box cut are shown on FIG. 4. No scrubber or sprays were applied. FIG. 5 shows the flow around the WR-I.

WR-II. Field Test Data and CFD Simulation Results

Two field tests were conducted to evaluate performance of WR-II. The first field test was performed for flow measurements only in an earlier prepared (bolted) entry. The second test was performed during ordinary mining cycle for methane and dust measurements.

Field Test 1. Flow Measurements

Figure 6A:
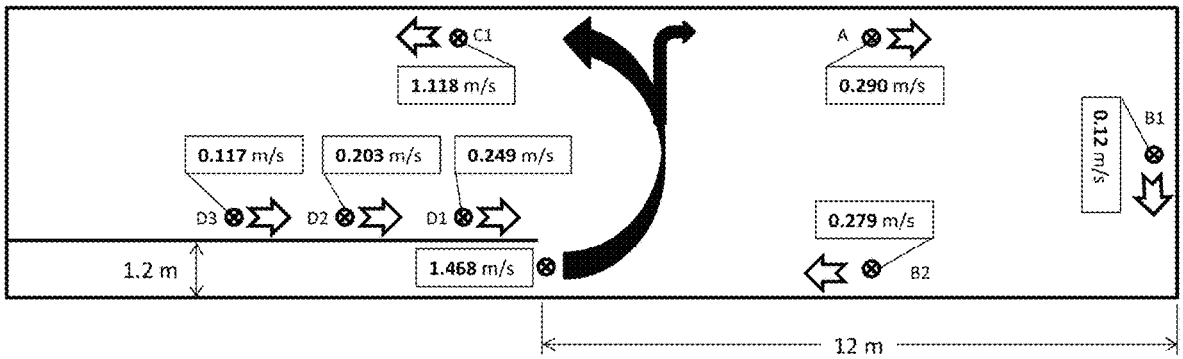
FIGS. 6*a* and 6*b* illustrate, respectfully, (a) measured airflow velocities and (b) CFD simulation results, airflow velocity vectors and contour map with velocity isolines for Scenario 1.
Figure 6B:
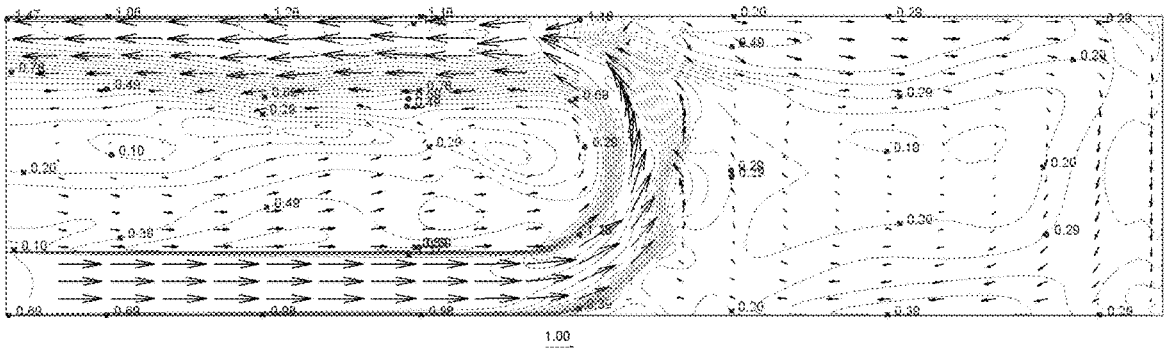

In the first test flow measurements were performed for three scenarios. In Scenario 1, a typical setup of a blowing curtain face ventilation system was built in an equipment free entry and velocities were measured using hot wire anemometer. The velocities were measured in 8 points as shown in FIG. 6. The entry dimensions were as follows: 5.7 m (18.5 ft) width, 2.2 m (7 ft) height, and 12 m (39 ft) curtain setback distance from the face. The curtain was set at 1.2 m (4 ft) from the rib. The measured intake flow rate was 3.96 $m^3/s$ (8381 cfm). The measurements were taken in the middle plane of the entry. The results showed, that intake air stream separated immediately from the rib at the curtain discharge by reaching maximum depth of 3 m (9.8 ft) at the middle of the entry width. The flow separation caused the secondary air stream (see point A) to flow along the off-curtain side rib instead of the curtain-side, which reverses the flow direction at the face zone. The velocity measured in point B1, located at 0.6 m (2 ft) out by the face, was 0.12 m/s (25 ft/min). A reversed return stream along the curtain, flowing toward the face, was observed at points D1, D2, and D3.

Figure 7A:
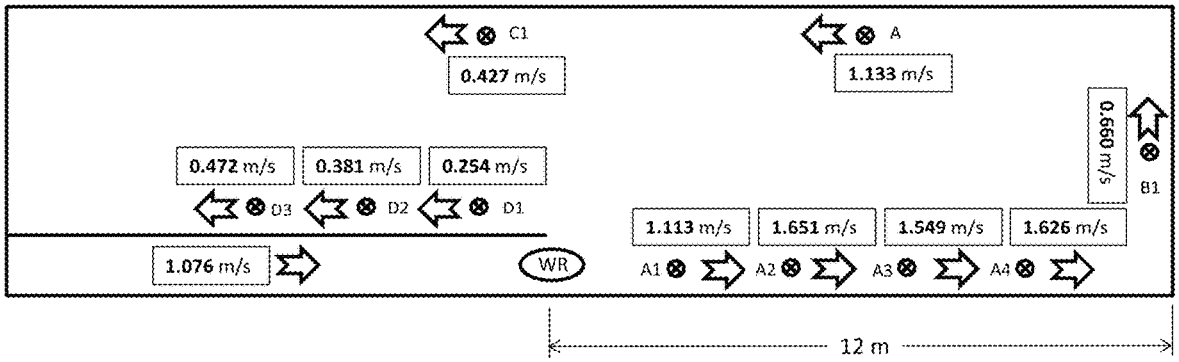
FIGS. 7*a* and 7*b* illustrate, respectively, (a) measured airflow velocities and (b) CFD simulation results, airflow velocity vectors and contour map with velocity isolines for Scenario 2.
Figure 7B:
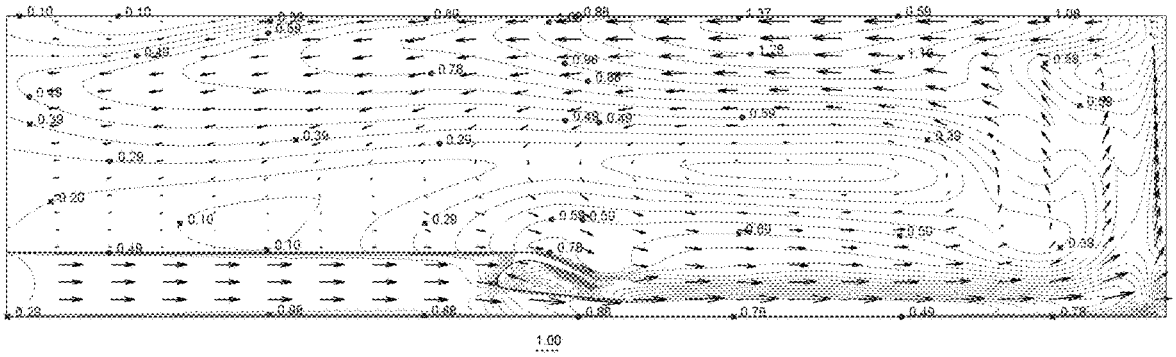

Scenario 2, the Wing Regulator was installed at the end of the curtain, and measurements were performed as shown on FIG. 7. The inflow rate, measured behind the curtain, was 2.9 $m^3/s$ (6114 cfm). The flow separation phenomenon, observed previously in Scenario 1, was eliminated. The reversed return stream along the curtain, at points D1, D2 and D3 was no longer observed. The velocity measured in point B1 was 5.5 times higher than the velocity measured at the same location for Scenario 1. Furthermore, in Scenario 2 the intake flow rate was less than in Scenario 1. The static pressure difference measured across the curtain was in range of 3.5-5 Pa.

Figure 8A:
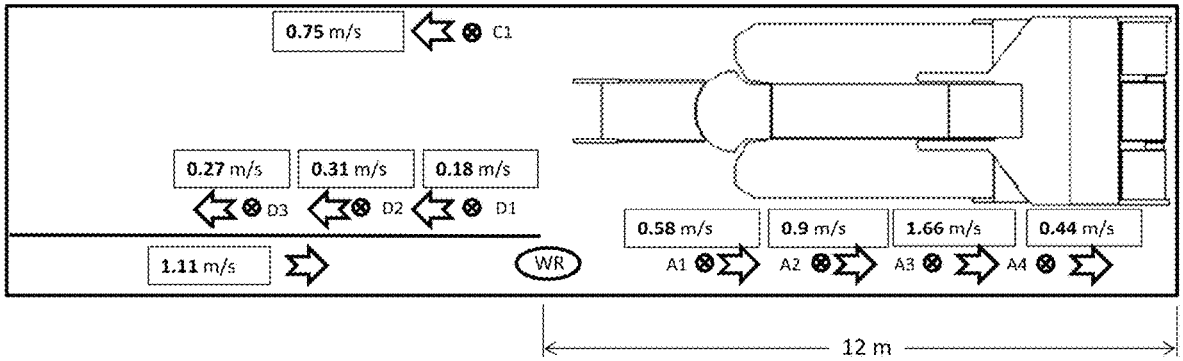
FIGS. 8*a*-8*c* illustrate, respectively, (a) measured airflow velocities, (b) CFD simulation results, air flow velocity vectors and contour map with velocity isolines and (c) CFD simulation results, vertical plan parallel to the air curtain, located 1 m from the curtain side rib for Scenario 3.
Figure 8B:
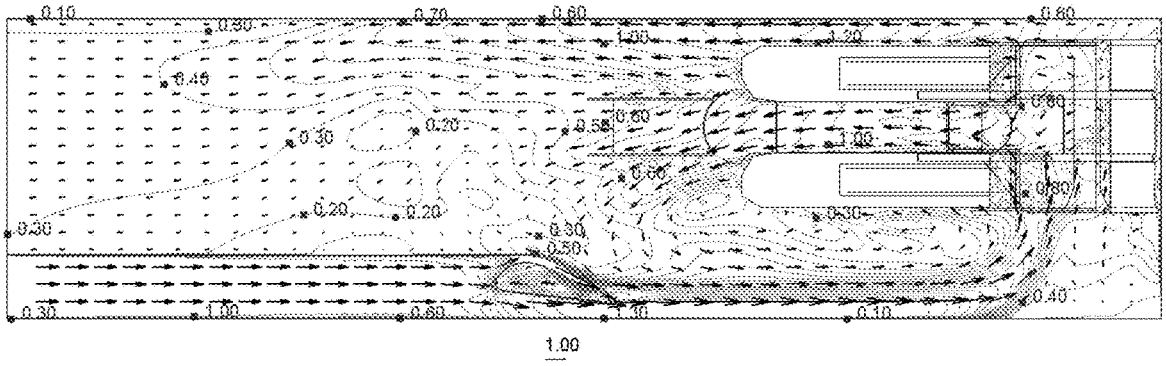
Figure 8C:
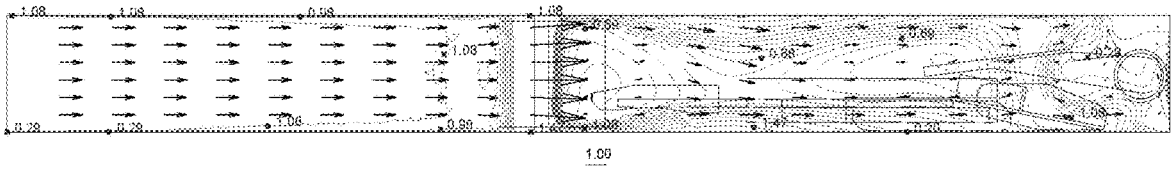
Figure 9:
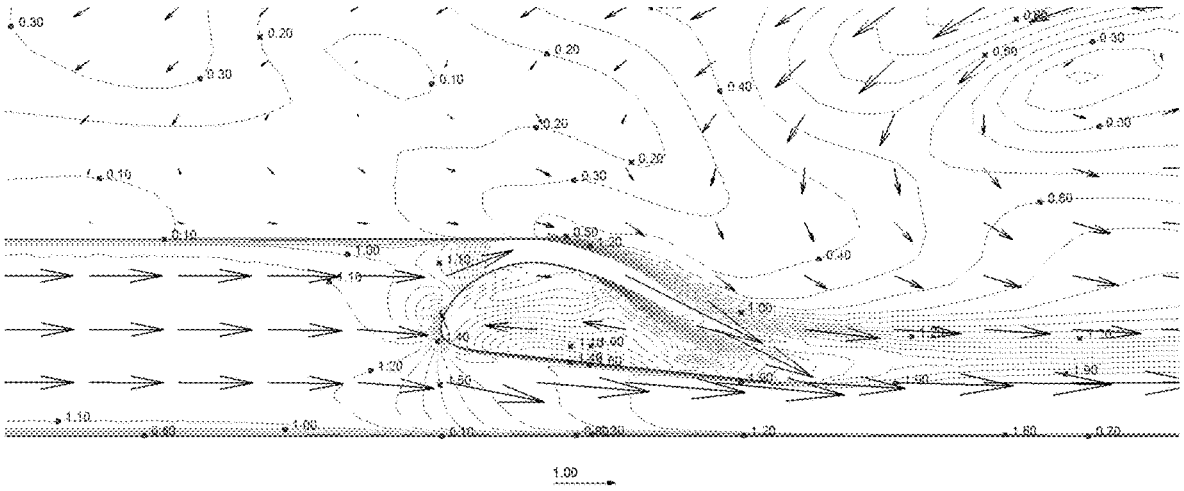
FIG. 9 shows simulation results for WR-II (vector field around airfoil).

Scenario 3, the performance of the Wing Regulator was tested with a continuous miner positioned at the end of the sump cut, as shown on FIG. 8. For this scenario, no early flow separation was observed. The return stream along the curtain, measured in points D1, D2, and D3 maintained its direction out by the face. The velocity distribution measured along the primary air stream, points A1 to A4, indicated a decreased amount of air close by the immediate face zone, caused by the presence of the continuous miner. Tests on physical models and CFD simulations proved that this could be regulated by the Wing Regulator angle of attack. The airflow around the WR-II is shown on FIG. 9.

Field Test 2. Methane and Dust Measurements

Figure 10:
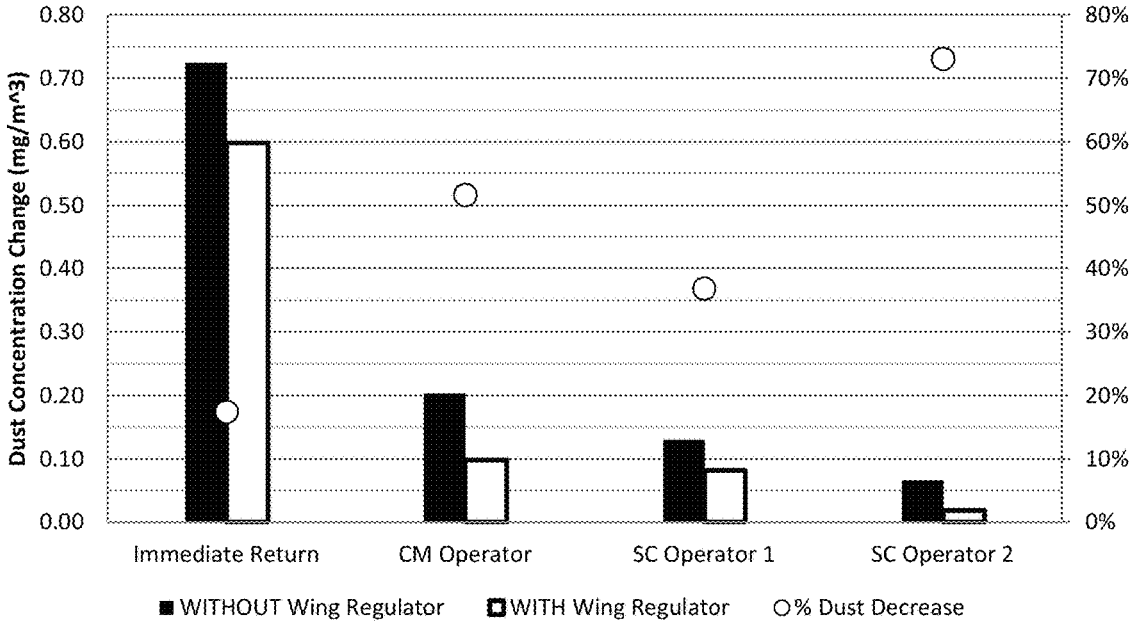
FIG. 10 is a graph illustrating single cut personal dust monitors (PDM) dust concentration comparison.

Personal Dust Monitors (PDM) for respirable dust mass measurements in mines were used for this test. Detailed information about PDM performance could be found in (Volkwein et. al., 2004). Five PDM instruments were used for this measurement as follows: at the intake stream behind the curtain; at the immediate return; at the continuous miner (CM) operator; at the shuttle car (SC) operator 1; and at the at the shuttle car (SC) operator 2. Two tests were performed during a typical cut with a continuous miner (CM), a single cut without and with Wing Regulator respectively. The results are shown on FIG. 10.

The curtain setback distance to the face was 12.2 m (40 ft). The results indicated potential for significant improvement in dust control at the continuous miner operator zone by using the Wing Regulator.

Figure 11:
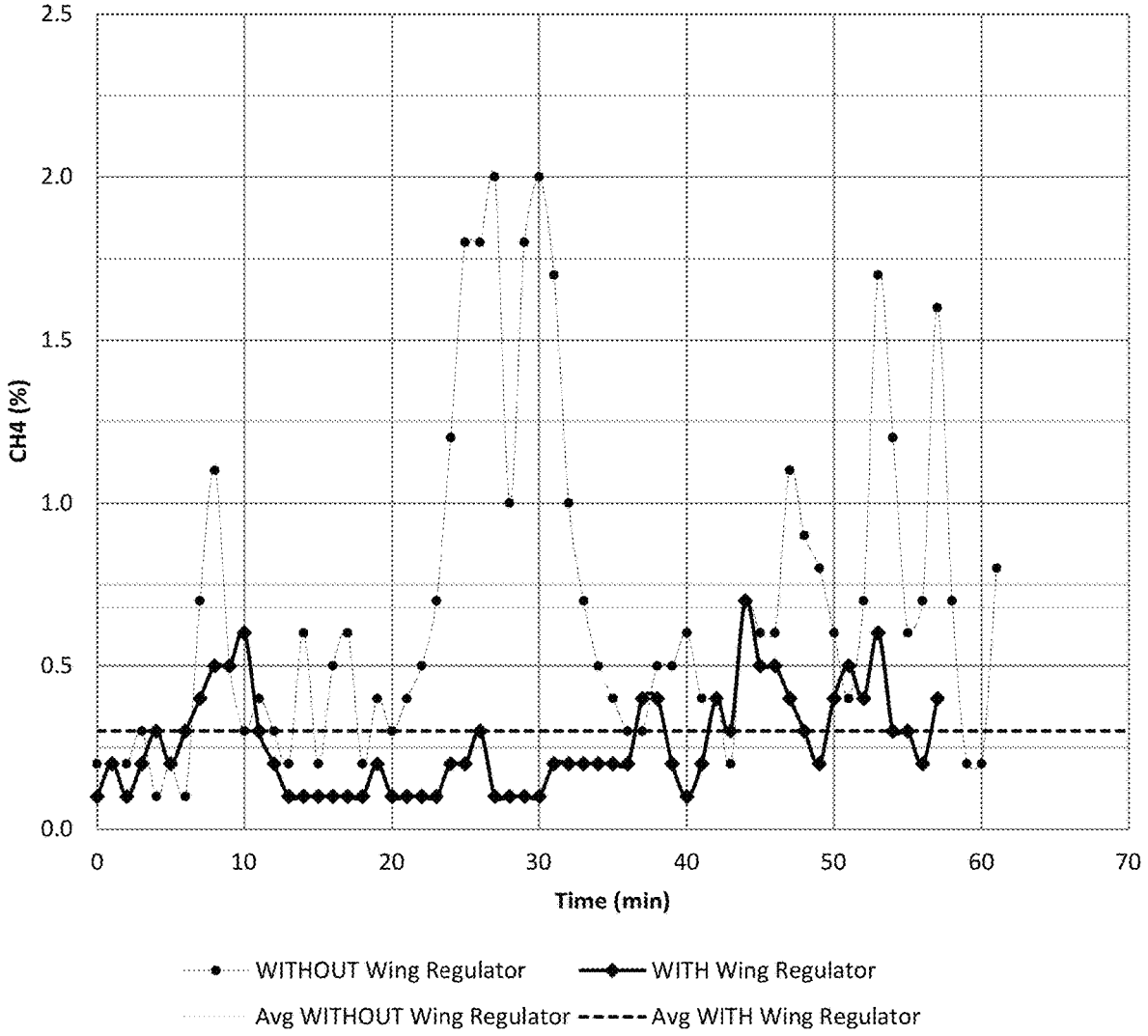
FIG. 11 is a graph illustrating single cut continuous miner methane concentration comparison.

The readings, shown on FIG. 11, were recorded following the built-in methane display monitor of the continuous mining machine.

The results showed the Wing Regulator significantly decreases pick concentrations and reduced the average methane concentration more than two times.

In summary, numerous benefits result from employing the system 10 and airstream regulator 14. Air is moved far more efficiently and effectively toward the coal face to sweep dust and methane from the immediate face zone toward the return and eventually out of the underground mine. The airstream regulator also provides a shelter space for a mining machine operator. The operator is protected from the airstream and dust in the shelter space. This allows the operator to see better so that he may more efficiently and effectively operate the mining machine. Thus, this represents a significant advance in the art which significantly improves mine safety and productivity.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A face ventilation system for directing a fresh airstream along a rib wall to an immediate face zone of a working area in an underground mine, comprising:

a blowing curtain;

an airflow ventilation source outside of the working area generating the fresh airstream; and;

a passive regulator including a curved leading edge of an airfoil adapted to receive the fresh air stream flowing along the rib wall, reduce separation of the fresh airstream from the rib wall and increase flow of fresh air into the immediate face zone to sweep dust and methane from the immediate face zone and eventually out of the underground mine.

2. The system of claim 1, wherein said blowing curtain is provided along and spaced from a rib wall of the underground mine so as to define a ventilation air path between said blowing curtain and a roof, a floor and the rib wall of the underground mine.

3. The system of claim 2, wherein said passive regulator is positioned in said air path at least partially between said blowing curtain and said rib wall upstream from the immediate face zone.

4. The system of claim 1, wherein said passive regulator is positioned in said air path with said curved leading edge oriented upstream and a trailing edge of said passive regulator pointed toward a mine face.

5. The system of claim 4, wherein said passive regulator is positioned in said air path adjacent a discharge end of said blowing curtain spaced upstream from a corner formed between the rib wall and the mine face.

6. The system of claim 1, wherein said passive regulator has a chord of 200 cm, a maximum thickness 40 cm at 29.8% of the chord, a maximum camber 9% at 30% of the chord.

7. The system of claim 1, wherein said passive regulator has a chord of 200 cm, a maximum thickness of 60 cm at 29.10% of said chord, a maximum camber of 9% at 31.50% of said chord.

8. The system of claim 1, wherein the passive regulator is separate from and not connected to the rib wall, the blowing curtain, or the airflow ventilation source.

* * * * *